United States Patent [19]

Guthke

[11] 4,441,712

[45] Apr. 10, 1984

[54] TENNIS RACKET STRING MOUNT

[76] Inventor: Horst Guthke, Münchener Str. 17, 8011 Forstern, Fed. Rep. of Germany

[21] Appl. No.: 309,398

[22] Filed: Oct. 7, 1981

[30] Foreign Application Priority Data

Oct. 13, 1980 [DE] Fed. Rep. of Germany ..... 3038663

[51] Int. Cl.[3] ..... A63B 49/02; A63B 51/12

[52] U.S. Cl. ..... 273/73 D; 273/73 E; 273/73 G

[58] Field of Search ..... 273/73 D, 73 E, 73 C, 273/73 R

[56] References Cited

U.S. PATENT DOCUMENTS

| | | | |
|---|---|---|---|
| 1,559,986 | 11/1925 | Quick | 273/73 E |
| 3,690,658 | 9/1972 | Howe | 273/73 C |
| 4,203,597 | 5/1980 | Reedhead et al. | 273/73 E |

*Primary Examiner*—Richard C. Pinkham
*Assistant Examiner*—Matthew L. Schneider
*Attorney, Agent, or Firm*—Michael J. Striker

[57] ABSTRACT

A tennis racket having a frame with a grip and a plurality of strings connected to the frame through a number of connecting elements permitting the displacement of an active connection point between the frame and the strings in a direction outwardly of the inner boundary of the frame.

20 Claims, 44 Drawing Figures direction of the hit
direction of the ball traveling
TB
R
Sr

Ri
Sa
R
D

Ra
Ri
Sa
D
Ri

R
Bo
Sa
D
Ra
Ri

R
Bo
Sa
R
Li
D
Ri
B1

Ra
Sa
R
B2
Ri
Z

D
Z
Li
Sa

Fig. 3
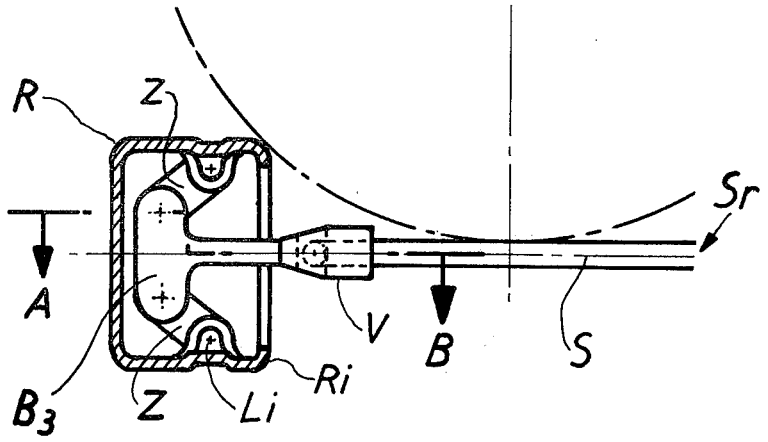
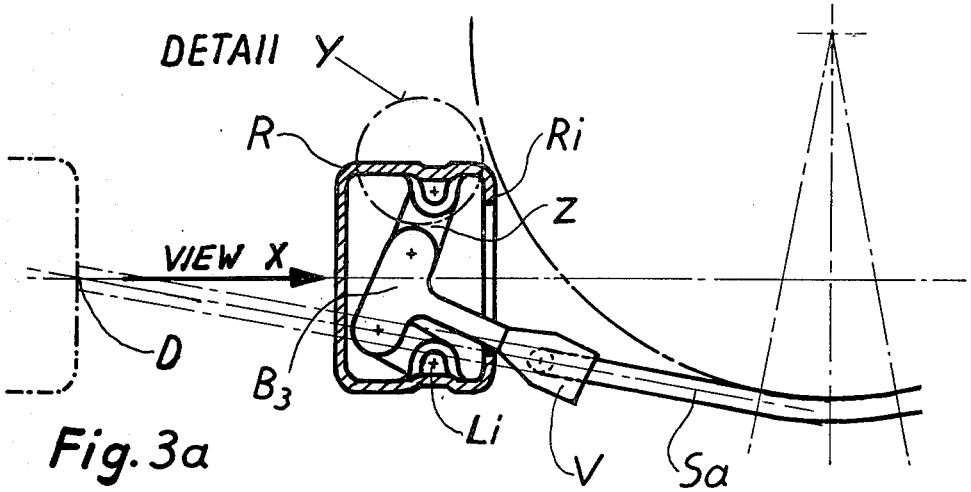
Fig. 3a
Fig. 3b
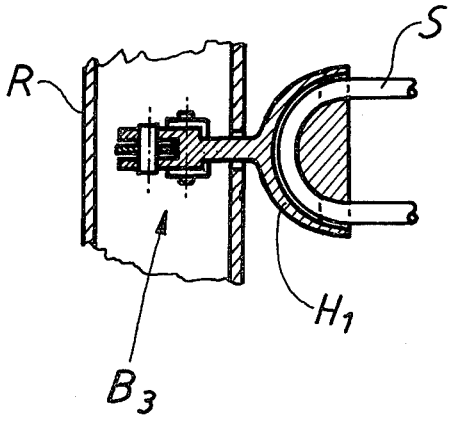

Fig. 6
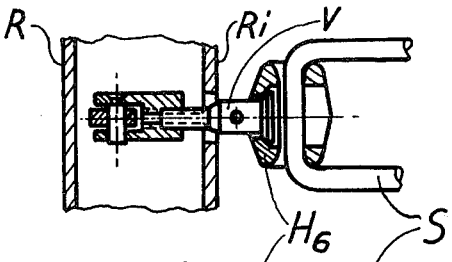
Fig. 7
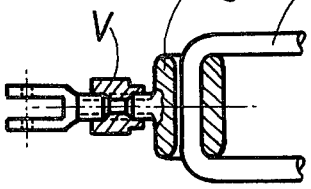
VIEW X
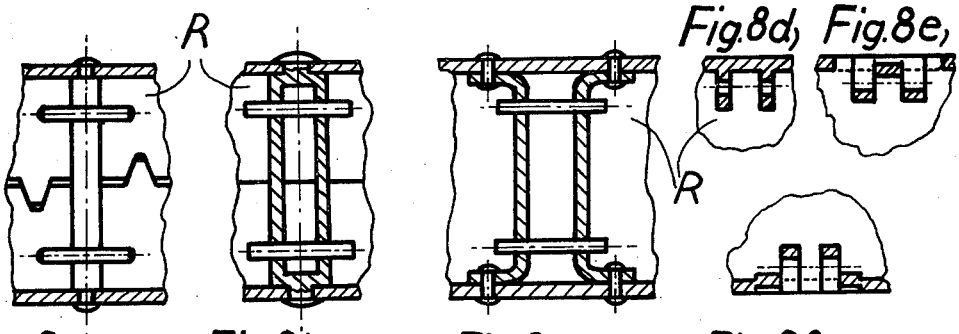
Fig.8 a) Fig.8b) Fig.8c) Fig.8d) Fig.8e) Fig.8f)
VIEW Y
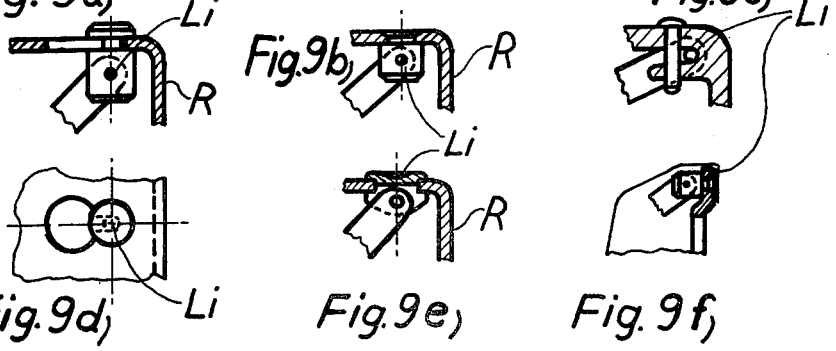
Fig. 9a) Fig.9b) Fig.9c) Fig.9d) Fig.9e) Fig. 9f)

Fig. 10 a)
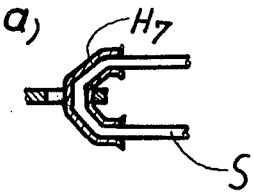
Fig.10b)
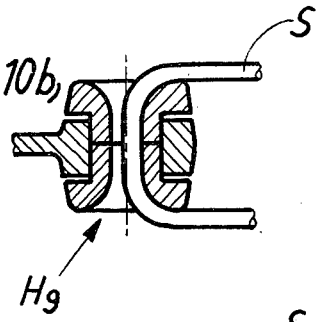
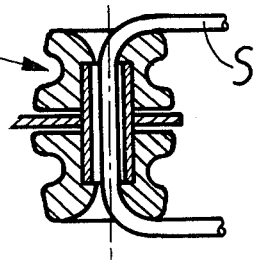
Fig. 10d)
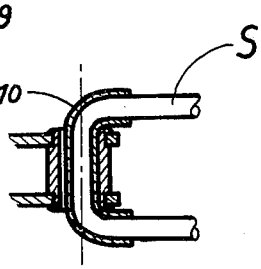
Fig.10c)
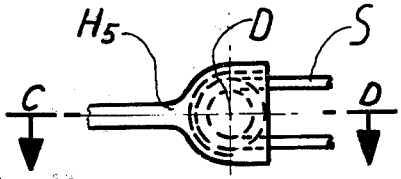
Fig. 10e)
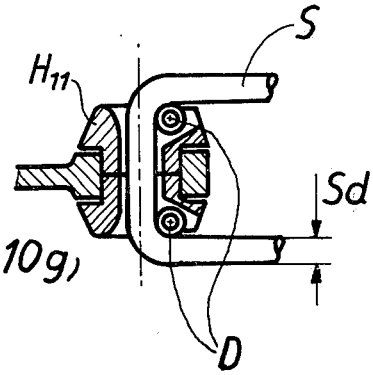
Fig. 10g)
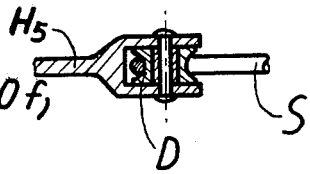
Fig. 10f)
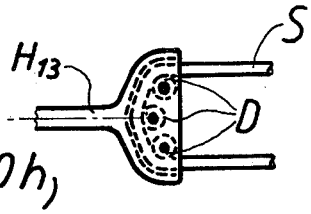
Fig.10h)

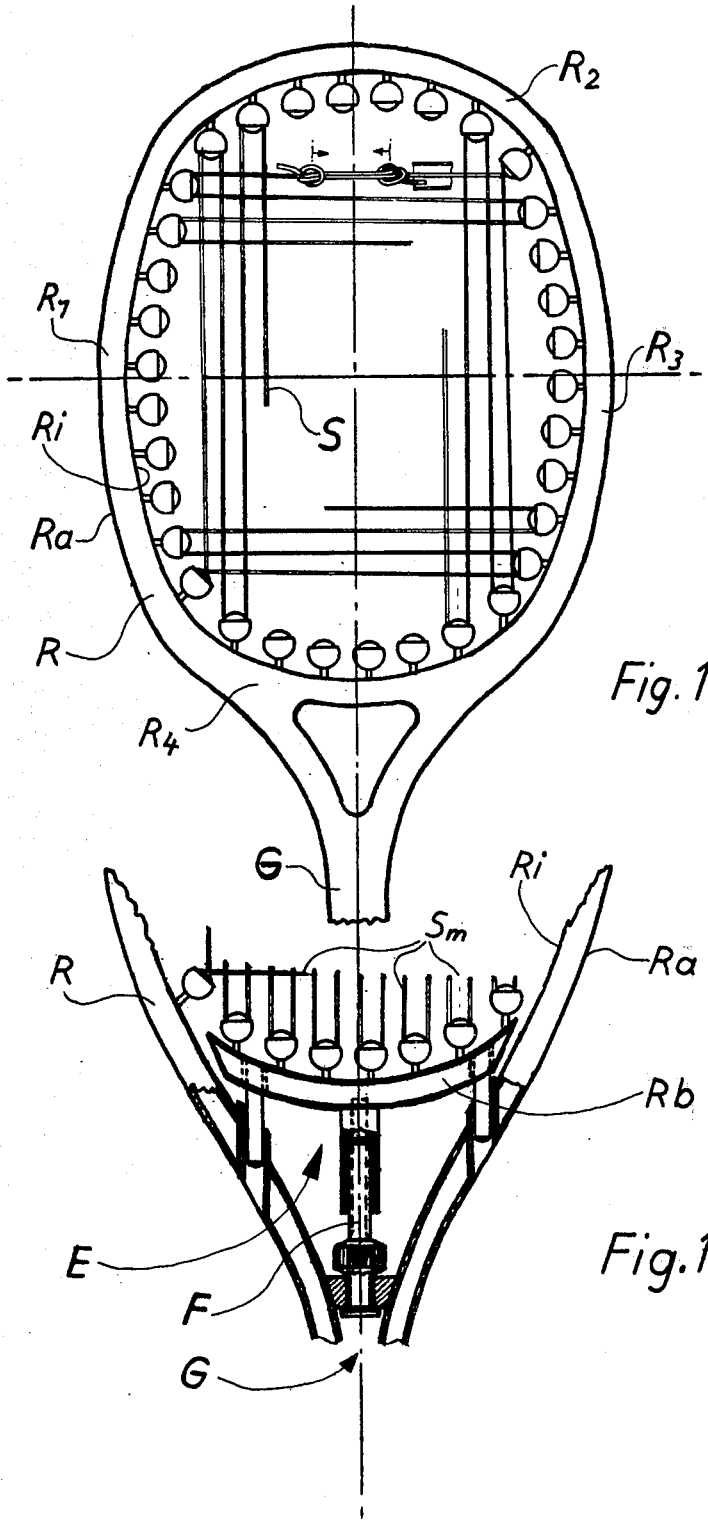
Fig. 11
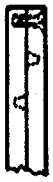
Fig. 11a
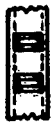
Fig. 11b
Fig. 12

TENNIS RACKET STRING MOUNT

BACKGROUND OF THE INVENTION

The present invention relates to a tennis racket.

Conventional tennis rackets include a frame and a flexible cloth comprising a plurality of intersecting strings which are connected to the frame. The strings when hit by a tennis ball diverge from the plane extending through the frame of the racket.

The tennis rackets of various structures are known in the art. The cloth of the racket is usually composed of one or many strings which extend through the openings provided in the frame and are thus connected to said frame.

When the tennis ball impinges against the strings it will deflect the strings over a predetermined angle because the strings function as a flexible diaphragm. However, in the region of connection of the strings to the frame, which is an edge region, the ball causes an asymmetrical deflection of the strings inasmuch as the ends of the strings are rigidly connected to the frame. In such situation the ball flying out of the strings is subject to an additional movement component, and therefore when a player hits the ball the direction of the movement of the ball traveling out from the strings is affected by said additional movement component. This effect may be compensated by a skilled player but not completely.

In order to solve the problem found in the rackets of the conventional type it has been proposed to produce tennis rackets with enlarged frames. It has been also suggested to connect the strings to the frame of the racket by springs; this, however caused an uncontrollable operation of the flexible strings.

SUMMARY OF THE INVENTION

It is therefore an object of the invention to avoid the disadvantages of the prior art.

More particularly, it is an object of the invention to provide an improved tennis racket.

Another object of this invention is to provide a tennis racket with an increased operative surface and with an improved edge area of the strings.

These and other objects of the invention are attained by a tennis racket, comprising a frame and flexible strings supported in said frame and connected thereto, said strings reciprocally moving between an inoperative and operative position and diverging from said inoperative position to the operative position when impinged by a tennis ball, the frame having an inner boundary facing said strings and an outer boundary facing away from said strings, the frame and the strings forming active points of connection when said strings are in said operative position, said points of connection being positioned in the region extending outwardly of said inner boundary.

The racket may further include connecting elements for securing the strings on the frame.

The frame may of a rectangular or circular cross-section.

The connecting elements may be pivotally supported on said frame. The connecting elements may have pivot points located in the proximity of said outer boundary of said frame, each of said connecting elements being adapted to pivot in a plane extending normal to a plane through which a respective one of said strings projects.

The racket may further include intermediate members interconnected between said connecting elements and the frame.

The racket may further include supporting members for holding the strings, said supporting members being connected to the respective connecting elements.

The connecting elements may have a T-shape configuration.

Each of the connecting elements may have a substantially triangular shape with three corners, two of said corners abutting against the interior wall of the frame facing towards the inner boundary of the frame when the strings are in said inoperative position while the third one of said corners facing outwardly of said inner boundary serves for connecting the respective string to the respective connecting element.

The strings may be so positioned in the supporting members that a slidable movement in a direction of their elongation and a deflection of said strings in a direction normal to said elongation are permitted.

The T-shaped connecting element may be formed as a flexible hair-needle bent piece having free ends and an intermediate head-like portion, said free ends having lugs connecting said intermediate members to said connecting elements, said head-like portion serving for supporting the respective one of said supporting members on the respective connecting element.

The tennis racket may further include a clamping device connecting the strings to the frame in the region of the grip of the racket.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 3 is an enlarged view of FIG. 2*c* but showing a tennis racket in an inoperative position;

FIG. 3*a* is a view of FIG. 3 but showing a tennis racket in a diverged position;

FIG. 3*b* is a sectional view along line A–B of FIG. 3;

FIG. 6 is a partial sectional view through the connection structure of the racket frame and racket cloth according to a still further embodiment;

FIG. 7 is a section through FIG. 6;

FIGS. 8*a*–8*f* are sectional views at arrow X as shown in FIG. 3*a;*

FIGS. 9*a*–9*f* illustrate partial sectional views, on enlarged scale, of a detail Y of FIG. 3*a* in accordance with further different embodiments of the invention;

FIGS. 10*a*–10*d* and 10*g* are sectional views, taken in portion of yet further embodiments of a lateral connection of the frame with the racket cloth;

FIG. 10*e* is a partial side view of the lateral connection according to still another embodiment;

FIG. 10*f* is a sectional view on line C–D of FIG. 10*e;*

FIG. 10*h* is a partial side view of the lateral connection of the frame and the racket string of yet further embodiment of the invention;

FIG. 11 is a front view of the tennis racket of the invention;

FIG. 11*a* is a partial side view of the racket frame as viewed from outside;

FIG. 11*b* is a partial side view of the racket frame as viewed from inside; and FIG. 12 is a partial sectional view of a clamping device of the tennis racket according to the invention.

DETAILED DESCRIPTION OF THE PREFERRED EMBODIMENTS

Figures 1, 1A, 2, 2A, 2B, 2C:
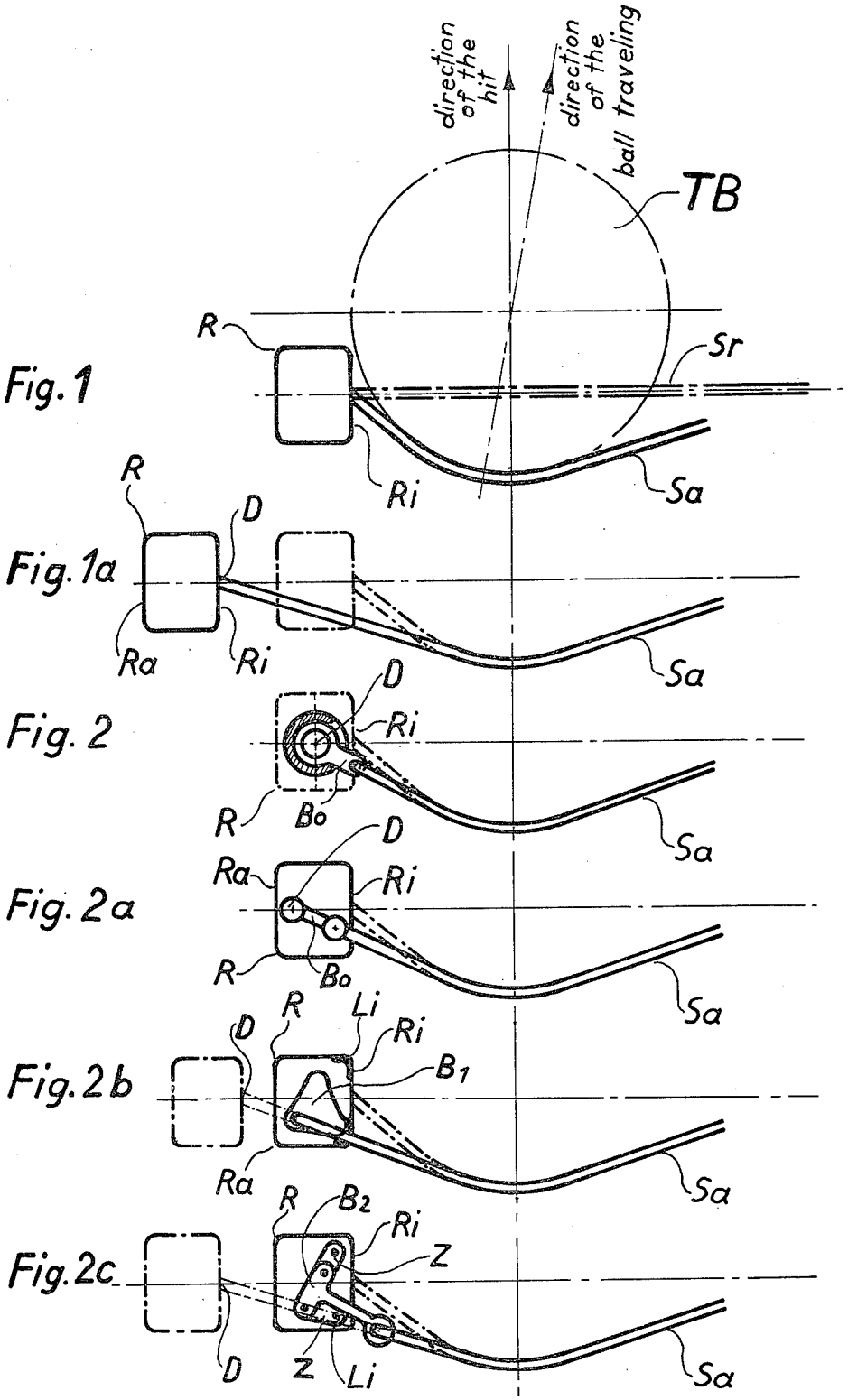
FIG. 1 is a schematic view showing a relationship between a tennis racket shown in portion, and a ball at the moment of its largest deviation caused by the impact of the tennis ball.
FIG. 1*a* is a schematic view showing a relationship as illustrated in FIG. 1 but with an increased diameter of a frame of the racket.
FIG. 2 is a partial side view of the racket in accordance with one embodiment of the invention.
FIG. 2*a* is a side view of a further modification of the racket frame.
FIG. 2*b* is a partial side view of a still further modification of the racket frame.
FIG. 2*c* is a partial side view of another modification of the racket frame.

Referring to the drawings, and first to FIG. 1, this figure illustrates schematically a physical correlation between a tennis ball TB and a tennis racket at the moment of the largest lateral displacement of the racket string when the latter is hit by the ball in the proximity of the edge of the string cloth. In this case, one can observe that when the tennis ball contacts the racket the dependence of the direction of traveling of the ball out of the racket upon the direction of the impact becomes uncontrollable. This is the case of conventional types of rackets.

The frame of the tennis racket is designated as R, whereas the string in its inoperative position is denoted as Sr and in its operative or diverged position as Sa. The strings or cloth of the racket are rigidly secured to the frame in a conventional manner so that when the strings are deviated the inner wall or boundary Ri of the frame acts as a suspension point. As seen in FIG. 1 during reciprocal action of the tennis ball TB when the latter contacts the string in the proximity of the frame the direction of the ball leaving the string deflects from the direction of the ball impact, this leads to a large assymetry and thus significant deformation of the diverged string Sa in the vicinity of the frame.

FIG. 1*a* shows a view illustrating the frame R with an increased diameter of the string which leads to an increased distance between the point of connection of the frame R with the string and the point of impinging of the ball against the string. As seen in FIG. 1*a* the deviation of the diverged string Sa is symmetrical; and the direction of the ball traveling out from the string in this case approximately corresponds to the direction of the impact of the ball. The active point D of rigid connection of the frame with the string lies in this case out of the inner boundary Ri of the frame.

Of course, it is understood that the increased dimension of the frame carrying the strings makes the tennis racket larger, heavier and thus more difficult to handle than those with the conventional frame dimension as shown in FIG. 1 and FIG. 1*a* in a dotted line. Furthermore, the use of the tennis rackets with the increased edge area as shown in FIG. 1*a* causes an undesirable leverage action on the arm of a user.

It is also desired that the active connection point of the string will lie as far as possible from the outer wall Ra of the frame without, however, further increasing of the size of the frame.

The first embodiment of the invention is depicted in FIG. 2. The frame R at least in the region of the connection point D with the string is hollow. The string is not secured immediately on the frame but is provided with a connecting element BO which is pivotally supported in the frame R and adapted to pivot out of the plane of the string. In this case the active connection point lies in the middle of the frame profile which, in order to save the weight of the frame, can have a substantially cylindrical cross-section. As seen in the drawing, the frame can have a substantially rectangular profile shown in a dotted line. The connecting element Bo shown in FIG. 2 includes an outer sleeve and an inner sleeve of which the outer sleeve contacts the inner wall of the frame profile. The dotted line in FIGS. 1*a* and 2 depicts the diverged string in a conventional type of connection of the string Sa to the frame R. If one compares the conventional connection with those shown in FIGS. 1*a* and 2 one can see that the point of connection D is remoter from the point of contact of the ball with the string and therefore the symmetry of the deviation of the string is improved.

FIG. 2*a* shows a further embodiment of the invention in which the connection point D is located even closer to the outer wall Ra than those previously described. The symmetry of the string deviation is thus further improved. In all above disclosed examples the connection point D lies inside the outer wall Ra of the frame. Because of this fact the useful area of the surface of the tennis racket is significantly increased.

In the modifications which will be explained in detail below the active connection point D lies in the area extending beyond the outer wall Ra of the frame so that even better symmetry of the string deviation will be obtained.

FIG. 2*b* illustrates a frame profile of a substantially rectangular shape. The connection element B1 has a triangular configuration with three rounded corners.

The inner wall Ri, is provided with interior reinforcement pieces Ll. The base side of the triangular connection element B1, which faces the inner wall Ri is somewhat smaller than the inner wall Ri. The string Sa is connected to the end of the connection element B1, which is opposite to that, carrying the connection point D. The string joined to the connection element B1 then passes through a corresponding slot formed in the inner wall Ri.

As seen in FIG. 2*b* the connection element Bo turns at a corresponding angle due to the deviation of the string Sa. In an inoperative position of the string both corners of the base side of the connection element abut against the reinforcement pieces Ll. The active connection point D lies in the area extending beyond the frame R; this is shown by a dotted line showing a simulated illustration of the significantly increased frame.

In contrast with the usually diverged string the string shown by the dotted line shows a significant correction of the symmentry of the deviated string.

The frame profile may not be necessarily rectangular; sometimes it, for example corresponds to the contour of movement of the corner of the triangular connection element in an outward direction.

FIG. 2*c* shows a further embodiment of the invention with an additional improved quality. The embodiment of FIG. 2*c* is further shown in detail in FIGS. 3*a* and 3*b*.

In this embodiment a T-shaped connection element B2 is provided for connecting the string to the frame. The element B2 is pivotally supported on two intermediate members Z connected to two opposite inner walls of the hollow frame R. The connection element B2 is adapted to pivot in a plane normal to the plane extending through the string in its inoperative position.

As seen from FIG. 3 the T-shaped connection element B3 (B2 in FIG. 2*c*) is in its intermediate position due to the tension of the connection when the string is in its inoperative position. When the ball hits the string the string deviates and takes a position denoted as Sa. The connection element B3 then pivots to a position shown in FIG. 3*a*. The active connection point D thus extends outwardly of the frame R as is again shown in a simulated illustration of the "increased" racket (dotted line). The symmetry of the diverged string is again improved.

FIG. 3*b* shows a section A–B through FIG. 3. The string S is so supported in a supporting member H1 that the string can slide in the direction of its elongation and at the same time is prevented from undesired bending. The supporting member H1 is, as seen in the drawing, integral with the connecting element B3 and includes a portion V holding the string. The T-shaped element B3 is terminated with a joint on which the portion V of the supporting member Hl is supported.

Figure 4:
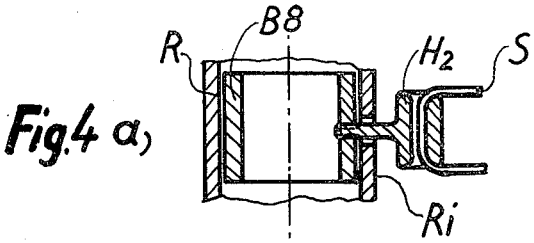
FIGS. 4*a*–4*g* are partial sectional views through line A–B of FIG. 3 but showing different embodiments of the connection between the frame and the string of the tennis racket.
Figure 4:
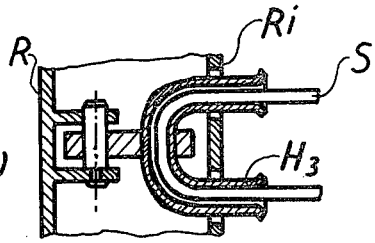
Figure 4:
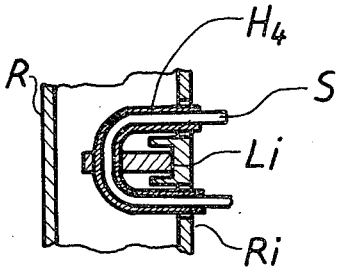
Figure 4:
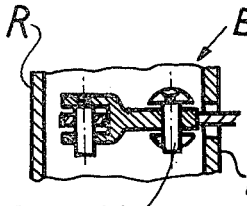
Figure 4:
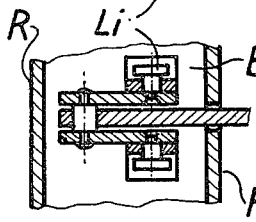
Figure 4:
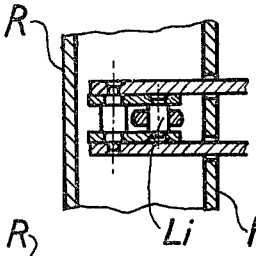
Figure 4:
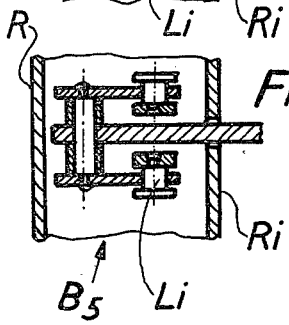

With reference to FIGS. 4*a*–4*g*, it is seen that the supporting member may have different structures. FIG. 4*a* shows the embodiment of FIG. 2 but on the enlarged scale. B8 is a tubular connection element located within the frame R so that the outer surface of the element B8 abuts against the inner wall of the frame. It is understood that connection element B8 may as well be used in the frame having a curved cross-section of any configuration, for example a cask-shaped configuration.

FIG. 4*b* shows in cross-section the embodiment illustrated in FIG. 2*a*. The string-supporting member H3 is formed as a curved tube in which the string S is mounted with a sufficient clearance.

FIG. 4*c* shows the cross section of the modification of FIG. 2*b* the operation of which was explained in detail herein above. The string-supporting member H4 is similar to member H3 of FIG. 4*b*.

FIG. 4*d* shows a pivot Li located in the vicinity of the inner wall R1.

In FIGS. 4*d* and 4*e* to 4*g* the different embodiments are shown which correspond to the structure illustrated in FIG. 2*c*; the operation of this structure has been described above. In these embodiments intermediate members (Z in FIG. 2*c*) are provided for supporting the connection element. The symmetrical divergence of the strings during operation is warranted in all the above-described embodiments.

Figure 5A:
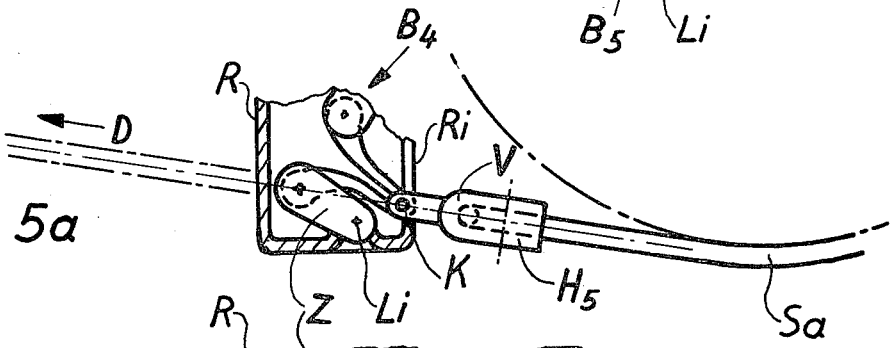
FIG. 5*a* is a partial side view of lateral connecting elements in accordance with further modification of the invention.
Figure 5B:
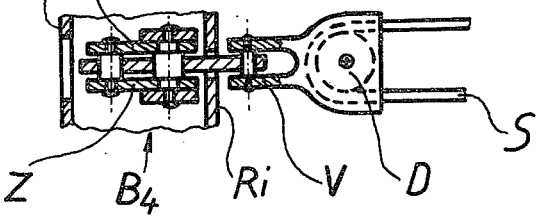
FIG. 5*b* is a sectional view through the connection FIG. 5*a;*

FIGS. 5*a* and 5*b* show a still further modification of a connection arrangement of this invention. The connection element B4 having generally a T-shape configuration is composed of a needle-like bent flexible piece, the free ends of which carry lugs which connect the element B4 to the intermediate members Z. The head portion K of the flexible element B4 serves for connection thereof with the supporting member H5 whose end portion V is pivotally supported relative to the head portion K of element B4.

FIGS. 6 and 7 illustrate a special intermediate element V interposed between the connection element and the supporting member H6 holding the string S. The intermediate element V is at its one end provided with a thread extended into a threaded hole formed in the connection element. By rotating the intermediate element V one can locally control the tension of the strings. Such controllable string-supporting members can be used only at the most important locations of the strings.

FIGS. 8*a* to 8*f* illustrate the details and different structures of the frame of the tennis racket. The frame R may be made out of several portions connected to each other by means of rivets, bolts, or catches, so as to form a substantially symmectrical hollow frame having openings for receiving bearings or pivots for holding the supporting members.

FIGS. 9*a* to 9*f* show the variations of bearing supports for intermediate members Z.

In FIGS. 10*a* to 10*h* various modifications of the string supporting elements are shown, which permit the movement of the strings in a direction of their elongation as well as their rotation.

The simpliest modification involves a tubular member H7 which has a sloped portion. The supporting element Hg shown in FIG. 10*b* includes two inserted one-into-another portions.

In order to limit a swivel-feature of the strings an inner axle inserted into the supporting element H8 (FIG. 10*d*) or H10 (FIG. 10*c*) is provided in the device.

In order to improve the movability of the strings in the longitudinal direction the connection arrangement may further include a roller (FIGS. 10*e* and 10*f*). The modification of the string-supporting element shown in FIG. 10 may be provided with additional rollers as shown in FIG. 10*g*.

FIG. 11 illustrates an embodiment of the tennis racket according to the invention. One can assume that the frame is not oval but consists of four approximately identical portions such as, for example defined by R1–R4. As was mentioned above the frame R can include two symmetrical halves as shown in FIG. 1*a*. FIG. 11*b* shows a side view of an integral frame which is provided with slots which serve for receiving connecting elements passing therethrough.

As was described above, the individual connection elements may be so formed that the tension of the strings is adjustable. With reference to FIG. 12, a handle G of the tennis racket is connected to a frame element Rb, which is separated from the frame, by a tension bolt F and a number of lateral axles slidably positioned in corresponding guideways in the handle. It is understood that the distance between the frame element Rb connected to the strings and holding the latter and the handle G and thus the position of element Rb may be varied due to the thread of the bolt F. The damping device including the tension bolt F and the frame element Rb serves for holding at least three strings Sm.

It is to be realized that certain elements of different modifications described herein above may be combined in any desired manner.

It will be understood that each of the elements described above, or two or more together, may also find a useful application in other types of tennis rackets differing from the types described above.

While the invention has been illustrated and described as embodied in a tennis racket, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tennis racket comprising a frame; strings supported in said frame and connected thereto, said strings reciprocally moving between an inoperative and operative position and diverging from said inoperative position into said operative position when impinged by a tennis ball, said frame being at least partially hollow and including an interior wall and an exterior wall and having an inner boundary facing said strings and an outer boundary facing away from said strings; connecting elements for connecting said strings to said frame; and intermediate members interconnected between said connecting elements and said frame, said connecting elements being pivotally mounted to said frame at respective pivots located in the proximity of said outer boundary of said frame and mounted between said frame and said intermediate members, each of said connecting elements being adapted to pivot about a respective pivot normally to the elongation of the respective string in the inoperative position so that when the strings are in said operative position they form with said frame active connection points which are positioned in the region extended outwardly from said inner boundary in a direction away from the strings, said connecting elements including portions provided with additional pivots operatively connected to the respective strings.

2. The racket as defined in claim 1, wherein said connecting elements have a T-shape configuration.

3. The racket as defined in claim 2, further including supporting members for holding said strings, said supporting members being connected to the respective connecting elements.

4. The racket as defined in claim 3, wherein each of said T-shaped connecting elements includes a joint on which the respective supporting member is supported.

5. The racket as defined in claim 3, wherein said strings are so positioned in said supporting members that a slidable movement of said strings in a direction of their elongation and a deflection of said strings in a direction normal to said elongation are permitted.

6. The racket as defined in claim 5, wherein each said supporting member is a one-piece curved tubular element adapted to pivot with respect to the respective connecting element.

7. The racket as defined in claim 5, wherein each said supporting member is composed of two preferably symmetrical halves and adapted to pivot with respect to the respective connecting element.

8. The racket as defined in claim 5, wherein each said supporting member includes a roller on which the respective string is supported.

9. The racket as defined in claim 3, wherein said T-shaped connecting element is formed as a flexible hair-needle bent piece having free ends and an intermediate head-like portion, said free ends having lugs connecting said intermediate members to said connecting elements, said head-like portion serving for supporting the respective one of said supporting members on the respective connecting element.

10. The racket as defined in claim 3, wherein each said supporting member includes an intermediate portion which functions as a clamping element for the respective connecting element.

11. The racket as defined in claim 10, wherein said intermediate portion has a thread insertable into said connecting element whereby the intermediate portion is adjustable in the direction of elongation of the respective string held by said supporting member.

12. The racket as defined in claim 2, wherein said T-shaped connecting element is a one-piece item interconnected between two said intermediate members.

13. The racket as defined in claim 1, further including supporting members for holding said strings, said supporting members being connected to the respective connecting elements.

14. The racket as defined in claim 1, wherein said frame has a substantially rectangular cross-section.

15. The racket as defined in claim 1, wherein said frame has a substantially circular cross-section, each of said connecting elements being of a substantially circular cross-section and inserted into said frame so that the outer surface of said connecting element abuts against said interior wall of said frame.

16. The racket as defined in claim 1, wherein said connecting elements have a rod-like configuration.

17. The racket as defined in claim 1, including a clamping device connecting said strings to said frame in the region of a handle of the racket.

18. The racket as defined in claim 17, wherein said clamping device is adapted to hold at least three strings.

19. The racket as defined in claim 18, wherein said clamping device includes a frame portion connected to said handle and being adjustable relative to said handle.

20. The racket as defined in claim 19, wherein said frame is provided with guidways and said adjustable frame portion with lateral axles adapted to slidably move within said guideways, said clamping device further including a clamping bolt connecting said handle to said frame portion.

* * * * *